US005935754A

United States Patent [19]

Almog

[11] Patent Number: 5,935,754

[45] Date of Patent: Aug. 10, 1999

[54] PREPARATION OF LIQUID TONERS CONTAINING CHARGE DIRECTORS AND COMPONENTS FOR STABILIZING THEIR ELECTRICAL PROPERTIES

[75] Inventor: Yaacov Almog, Rehovot, Israel

[73] Assignee: Indigo N.V., S.M. Veldhoven, Netherlands

[21] Appl. No.: 09/072,561

[22] Filed: May 5, 1998

Related U.S. Application Data

[62] Division of application No. 08/281,149, Jul. 27, 1994, Pat. No. 5,792,584, which is a continuation of application No. 07/933,081, Aug. 21, 1992, abandoned.

[51] Int. Cl.[6] ..... G03G 13/10

[52] U.S. Cl. ..... 430/119; 430/117

[58] Field of Search ..... 430/115, 117, 430/119

[56] References Cited

U.S. PATENT DOCUMENTS 3,507,679 4/1970 Metcalfe et al. ..... 430/115

OTHER PUBLICATIONS

Diamond, Arthur S. Handbook of Imaging Materials. New York: Marcel–Dekker, Inc. pp. 227–231, 1991.

*Primary Examiner*—Christopher D. Rodee

*Attorney, Agent, or Firm*—Greenblum & Bernstein P.L.C.

[57] ABSTRACT

The invention relates to a method for producing liquid toner compositions containing charge directors and in which the electrical properties of the charge directors are stabilized, which method comprises the steps of: (A) first making a homogeneous liquid composition which comprises (1) liquid hydrocarbon compatible with liquid toners for electrostatic imaging, (2) at least one charge director, and (3) at least one stabilizing component in an amount effective to stabilize the electrical properties of the at least one charge director, the stabilizing component being selected from solubilizable acids which include organic moieties (e.g. $C_{12}$ to $C_{18}$ saturated aliphatic carboxylic acids, $C_4$ to $C_{18}$ ethylenically unsaturated aliphatic carboxylic acids, $C_7$ to $C_{13}$ aromatic carboxylic acids, and partial alkyl esters of orthophosphoric acid containing 12 to 36 carbon atoms); and (B) mixing the homogeneous liquid composition from step (A) in any order with at least component (5) from the following components (5) and (6), namely, (5) pigmented thermoplastic resin particles, and (6) further liquid hydrocarbon as defined in (1), above, such that component (5) is microdispersed in the toner composition.

24 Claims, 5 Drawing Sheets

PREPARATION OF LIQUID TONERS CONTAINING CHARGE DIRECTORS AND COMPONENTS FOR STABILIZING THEIR ELECTRICAL PROPERTIES

CROSS REFERENCE TO RELATED APPLICATIONS

This application is a division of application Ser. No. 08/281,149, filed Jul. 27, 1994, now U.S. Pat. No. 5,792,584 which is a continuation of application Ser. No. 07/933,081, filed Aug. 21, 1992, now abandoned. The entire disclosures of application Ser. Nos. 08/281,149 and 07/933,081 are considered as being part of the disclosure of this application, and the entire disclosures of these applications are expressly incorporated by reference herein in their entirety.

FIELD AND BACKGROUND OF THE INVENTION

This invention relates to the field of electrostatic imaging and, more particularly, to the preparation of liquid toners containing components for improving the stabilization of the electrical properties due to the charge directors contained therein.

In the art of electrostatic photocopying or photoprinting, a latent electrostatic image is generally produced by first providing a photoconductive imaging surface with a uniform electrostatic charge, e.g. by exposing the imaging surface to a charge corona. The uniform electrostatic charge is then selectively discharged by exposing it to a modulated beam of light corresponding, e.g., to an optical image of an original to be copied or to a computer generated image, thereby forming an electrostatic charge pattern on the photoconductive imaging surface, i.e. a latent electrostatic image having a background portion at one potential and a "print" portion at another potential. The latent electrostatic image can then be developed by applying to it charged pigmented toner particles, which adhere to the "print" portions of the photoconductive surface to form a toner image which is subsequently transferred by various techniques to a copy sheet (e.g. paper).

It will be understood that other methods may be employed to form an electrostatic image, such as, for example, providing a carrier with a dielectric surface and transferring a preformed electrostatic charge to the surface. The charge may be formed from an array of styluses. This invention will be described in respect of office copiers and the like, though it is to be understood that it is applicable to other uses involving electrostatographics including electrostatographic printing.

In liquid-developed electrostatic imaging, the toner particles are generally dispersed in an insulating non-polar liquid carrier, generally an aliphatic hydrocarbon fraction, which generally has a high-volume resistivity above $10^9$ ohm cm, a dielectric constant below 3.0 and a low vapor pressure (less than 10 torr. at 25° C.). The liquid developer system further comprises so-called charge directors, i.e. compounds capable of imparting to the toner particles an electrical charge of the desired polarity and uniform magnitude so that the particles may be electrophoretically deposited on the photoconductive surface to form a toner image.

In the course of the process, liquid developer is applied to the photoconductive imaging surface. Under the influence of the electrical potential present in the latent image and a developing electrode which is usually present, the charged toner particles in the liquid developer film migrate to the "print" portions of the latent electrostatic image, thereby forming the developed toner image.

Charge director molecules play an important role in the above-described developing process in view of their function of controlling the polarity and magnitude of the charge on the toner particles. The choice of a particular charge director for use in a specific liquid developer system, will depend on a comparatively large number of physical characteristics of the charge director compound, inter alia its solubility in the carrier liquid, its changeability, its high electric field tolerance, its release properties, its time stability, the particle mobility, etc., as well as on characteristics of the developer. All these characteristics are crucial to achieve high quality imaging, particularly when a large number of impressions are to be produced.

A wide range of charge director compounds for use in liquid-developed electrostatic imaging are known from the prior art. Examples of charge director compounds are ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinyl-pyrrolidone, organic acid esters of polyvalent alcohols, etc.

Notwithstanding the undoubted utility of charge directors, however, the charging caused thereby is generally unstable. In particular, lecithin, basic barium petronate (BBP) and calcium petronate (CP), which are used as negative charge directors, are unstable under high voltage conditions. Thus, when a solution of charge director (or a dispersion of toner particles in carrier liquid and containing charge director) is subjected to a high electric field, e.g. during the development process, the charge transport characteristics and conductivity suffer from transient suppression, and it may take several minutes for these characteristics to recover. This leads to unstable printing performance when long print runs are undertaken. Further, such solutions or dispersions containing particularly BBP, CP and to a lesser extent lecithin, tend to lose conductivity in the course of time (after dilution with Isopar or other carrier liquids), so that, e.g., solutions or dispersions containing BBP or CP, when diluted with Isopar, will change their conductivity by about one order of magnitude in a day and a half. In this connection, it may be noted that in U.S. Pat. No. 4,897,332 (Gibson), there is described the use of alkylated polyvinylpyrrolidones in liquid toners, for the purpose of promoting their electrical stability under high voltage conditions.

In an attempt to improve the quality of the image formed, particularly when using liquid toners containing charge directors, it has been suggested to use adjuvants in the toner compositions, such as polyhydroxy compounds, aminoalcohols, polybutylene succinimide, an aromatic hydrocarbon, a metallic soap or a salt of a Group Ia, Ia, or IIIa metal.

In U.S. Pat. No. 3,681,243 (Okuno), the problem of stained prints in electrophotography with liquid toners, said to be due to lack of smoothness of the relevant surfaces and lack of uniformity of electrical charge, is stated to be solved by use of an additive, which may be a $C_{12-16}$ saturated monocarboxylic acid. According to Okuno's disclosure, the resin in the toner is a "polar-controlling resin", e.g. "Nikanol HP-100", the principal component of which is said to be phenol modified xylene resin. However, in this U.S. Patent, there is no explicit reference to the presence of a charge director.

U.S. Pat. No. 4,891,286 (Gibson) claims that pigment charge homogeneity and mobility in liquid toners are improved by the addition of carrier-liquid insoluble monomeric organic acids to the toner solutions. This patent stresses that the acids must be associated with the pigment-binder particle and must not exist free in the continuous liquid phase.

U.S. Pat. No. 5,002,848 (El-Sayed et al) discloses positive-working liquid developers, said to have improved charging characteristics, which consist essentially of (A) a non-polar liquid, (B) thermoplastic resin particles charged positive, (C) a nonpolar liquid soluble ionic or zwitterionic charge director compound, and (D) a substituted carboxylic adjuvant, which may be, in particular, (i) an alkane- or aryl-carboxylic acid, substituted by an electron-withdrawing group, or by a carboxylate anion-stabilizing moiety (e.g. OH, SH or thioether) in the a-position of an alkane carboxylic acid, (ii) an arylcarboxylic acid ortho-substituted by a carboxylate anion-stabilizing moiety, (iii) an analogously substituted alkylarylcarboxylic acid. This patent does not teach that ingredient (D) stabilizes the electrical properties of ingredient (C), or that there is any merit in the particular order, in which the various ingredients of the liquid toners are mixed together, in relation to stabilizing the electrical properties of the charge directors present.

SUMMARY OF THE INVENTION

It is an object of the present invention to provide a method for producing improved liquid toner compositions containing charge directors and components which stabilize the electrical properties of the charge directors. Other objects of the invention will appear from the description which follows.

The present invention accordingly provides a method for producing liquid toner compositions containing charge directors and in which the electrical properties of the charge directors are stabilized, which method comprises the steps of:

(A) first making a homogeneous liquid composition which comprises (1) liquid hydrocarbon compatible with liquid toners for electrostatic imaging, (2) at least one charge director, and (3) at least one stabilizing component in an amount effective to stabilize the electrical properties of the at least one charge director, the stabilizing component being selected from solubilizable acids which include organic moieties; and (B) mixing the homogeneous liquid composition from step (A) in any order with at least pigmented thermoplastic resin particles and, optionally, liquid hydrocarbon as defined in (1), above, such that the particles are micro-dispersed in the toner composition.

The liquid hydrocarbon, i.e. component (1) as defined above, is preferably an insulating non polar carrier liquid having a volume resistivity above $10^9$ ohm-cm and a dielectric constant below 3.0.

The solubilizable acids containing organic moieties include $C_{12}$ to $C_{18}$ saturated aliphatic carboxylic acids; $C_4$ to $C_{18}$ ethylenically unsaturated aliphatic carboxylic acids; $C_7$ to $C_{13}$ aromatic carboxylic acids; and partial alkyl esters of orthophosphoric acid containing 12 to 36 carbon atoms.

Examples of the saturated carboxylic acids are lauric acid and stearic acid. Examples of the ethylenically unsaturated aliphatic carboxylic acids are vinylacetic, crotonic and oleic acids. The $C_7$ to $C_{13}$ aromatic carboxylic acids may be substituted by alkyl or hydroxy and any alkyl groups present are included in the total of 7 to 13 carbon atoms; examples of these acids are benzoic, salicylic and diisopropylsalicylic acids. The partial alkyl esters of orthophosphoric acid include monoalkyl and dialkyl esters thereof, e.g., di(2-ethylhexyl) phosphate.

It has been found that toner compositions prepared according to the method of the invention exhibit excellent time stability of charge and less conductivity reduction loss under high voltage conditions, as well as excellent recovery of charge after subjection to high voltage conditions. Also, use of such toner compositions results in images of very good copy quality and relatively long stability.

The present invention yet further provides an electrostatic imaging process which comprises the steps of: forming a charged latent electrostatic image on a photoconductive surface; applying to said surface oppositely charged colorant particles from a toner composition prepared according to the method of the invention.

DETAILED DESCRIPTION OF THE INVENTION

Figure 1:
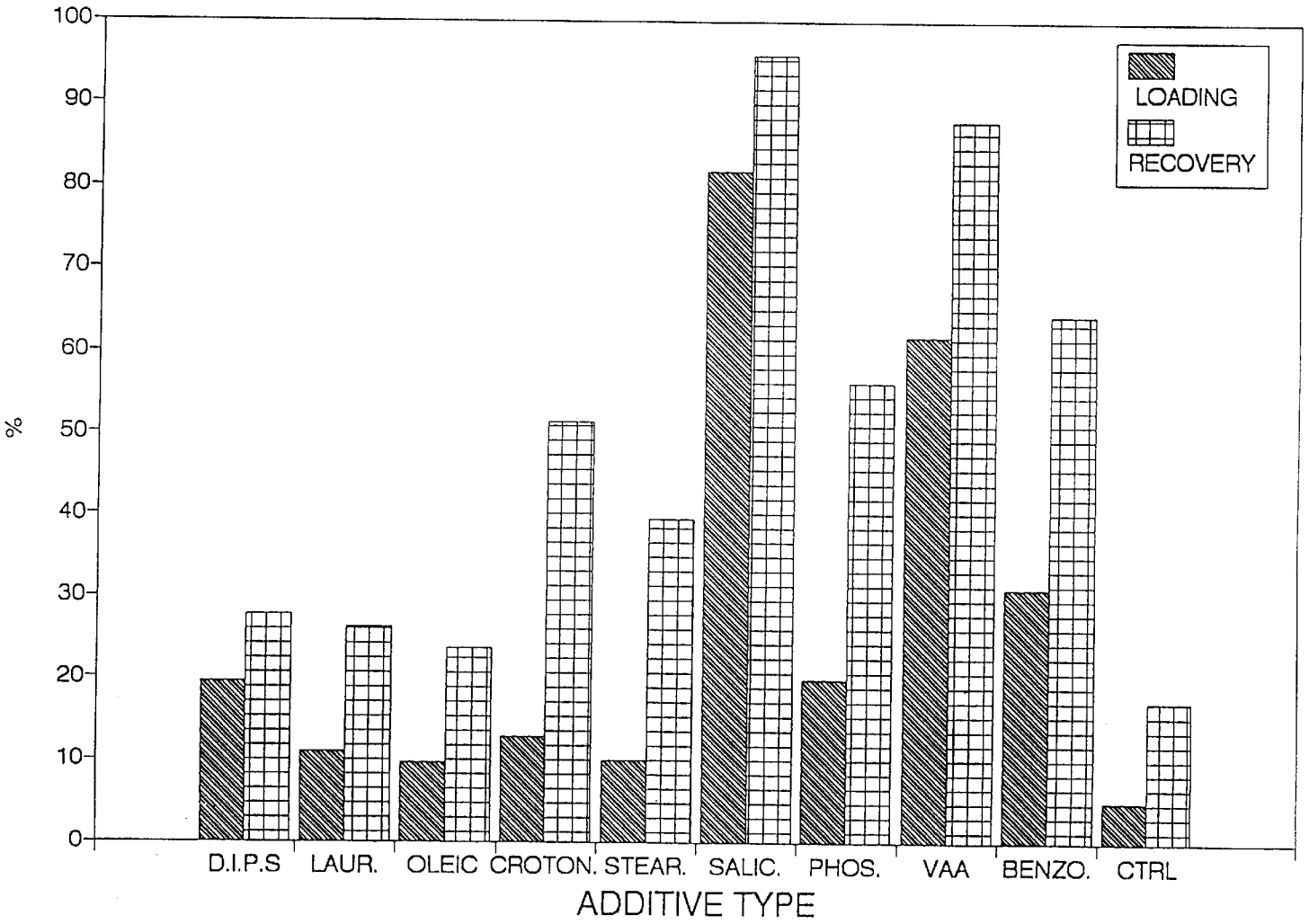
FIGS. 1–3 show the effect of the stabilizing component of the invention on the electrical stability of carrier liquid compositions containing charge directors.

The thermoplastic resins, insulating non-polar carrier liquids, colorant particles and charge directors, which may suitably be used in the toner compositions of the invention are known in the art. Illustratively, the insulating non-polar liquid carrier, which should preferably also serve as the solvent for the charge directors, is most suitably an aliphatic hydrocarbon fraction having suitable electrical and other physical properties. Preferred solvents are the series of branched-chain aliphatic hydrocarbons and mixtures thereof, e.g. the isoparaffinic hydrocarbon fractions having a boiling range above about 155° C., which are commercially available under the name Isopar (a trademark of the Exxon Corporation).

As set forth above, the at least one component for stabilizing the electrical properties of the at least one charge director is selected from solubilizable acids which include organic moieties. The term "solubilizable acids" in the present specification and claims means that the acids may be dissolved in liquid hydrocarbon (1) which contains component (2).

Where the stabilizing component(s) and/or charge director(s) are not soluble in the carrier liquid, it is preferred to solubilize them by heating, e.g. at about 40° C. The solution of stabilizing component(s) and charge director(s) may then be admixed with the diluted toner containing pigment and resin.

The weight ratio of stabilizing component to charge director in the liquid toners preferably falls within the range of 0.01–2.0:1.

The invention will be illustrated by the following non-limiting Example, in which all "parts" are parts by weight.

EXAMPLE (a) Ten parts of Elvax II 5950 (E.I. du Pont) and five parts of Isopar L (Exxon) are mixed at low speed in a jacketed double planetary mixer connected to an oil heating unit set at 130° C. for one hour. Five parts of Isopar L are added to the mix in the double planetary mixer and the whole is mixed for a further hour at high speed. Ten parts of Isopar L, preheated to 110° C. are added, and the mixing is continued for one hour; the heat is then turned off and mixing continues until the temperature of the mixture drops to 40° C.

(b) Ninety grams of the product of part (a) is transferred to a Union Process 01 attritor together with 7.5 g of Mogul L carbon black (Cabot) and 120 g Isopar L. The mixture is ground for 24 hours with water cooling (≈20° C.) using 3/16" stainless steel media. The resultant toner particles have an average (weight) diameter of about 2.1 μm.

(c) Four charge directors are used, namely, BBP (Witco) or CP-25H (Witco), and 50—50 mixtures of lecithin with BBP or CP. 600 g. Isopar L is used to dissolve 60 g. charge director(s) until a homogeneous solution is obtained, to which was added the stabilizing component(s) according to the invention, heating if necessary (e.g. at 40° C.) to obtain a homogeneous solution. The amount of stabilizing components) may be, e.g., 0.25–10 wt. % in the Isopar solution, but up to 1 wt. % is usually adequate. It is noted that BBP and CP when added to lecithin improve its humidity tolerance (which is poor when used alone); the stabilizing components do not appear to affect the humidity stability of any of the charge directors including the mixtures.

(d) The toner concentrate from part (b) is diluted to a non-volatile solids content of 1.5%, using Isopar L. Charge director solution including stabilizing component, from part (c), is added in an amount of e.g. 5–100 mg. charge director solids per g. of toner solids.

The toners thus produced were tested in a Savin 870 copier and in a printer using an intermediate transfer member. Print quality was equal to that of toner without the additives. Print quality was stable under high speed printing conditions, consistent with the following experiments on the stabilized charge director alone. In each of the cases in this example the charge director or mixture of charge directors was operative to impart a negative charge to the toner particles.

Electrical stability under high voltage applications

These measurements are made for solutions containing charge directors alone (as control), or with the addition of stabilizing components, prepared according to part (c) of the Example, above, and diluted with the same carrier liquid. A solution of 0.1 wt. % charge director (and, when present, stabilizing component in the concentrations described below) is placed in an electrical cell having a one mm. separation between plate electrodes. A first pulse of 1500 volts having a duration of 8 seconds is applied to the electrodes and the total charge transported is measured. This charge represents the "basis" value for comparison. After a 1 second delay a second pulse of 1500 volts having a duration of 68 seconds is applied; this pulse is designed to cause depletion of the charge director by high voltage loading. After a further 1 second delay a third pulse of 1500 volts having a duration of 8 seconds is applied and the total charge transported is measured. This charge represents the diminished charge transport capability of the material after being subjected to a high voltage. After a 1 minute wait an additional pulse of 1500 volts having a duration of 8 seconds is applied and the total charge transported is measured; this charge is a measure of the recovery of the charge director after being subjected to high voltage.

The results of this study are shown in FIGS. 1–4, which show clearly that addition of the stabilizing components in accordance with the invention improved both the pulse loading and recovery characteristics of the charge director. (In the Figures, LAUR.=lauric acid; STEAR.=stearic acid; VAA=vinylacetic acid; CROTON.=crotonic acid; BENZO.=benzoic acid; SALI. A. or SALIC.=salicylic acid; D.I.P.S=diisopropylsalicylic acid; and PHOS.=di(2-ethylhexyl) phosphate.) The charge director compositions in the Figures (concentrations of stabilizing components shown in parentheses) were prepared as follows:

FIG. 1: 0.05 g lecithin and 0.05 g BBP, with 0.01 g of the stated stabilizing component according to the invention, were dissolved in Isopar L to make 100 g total solution.

Figure 2:
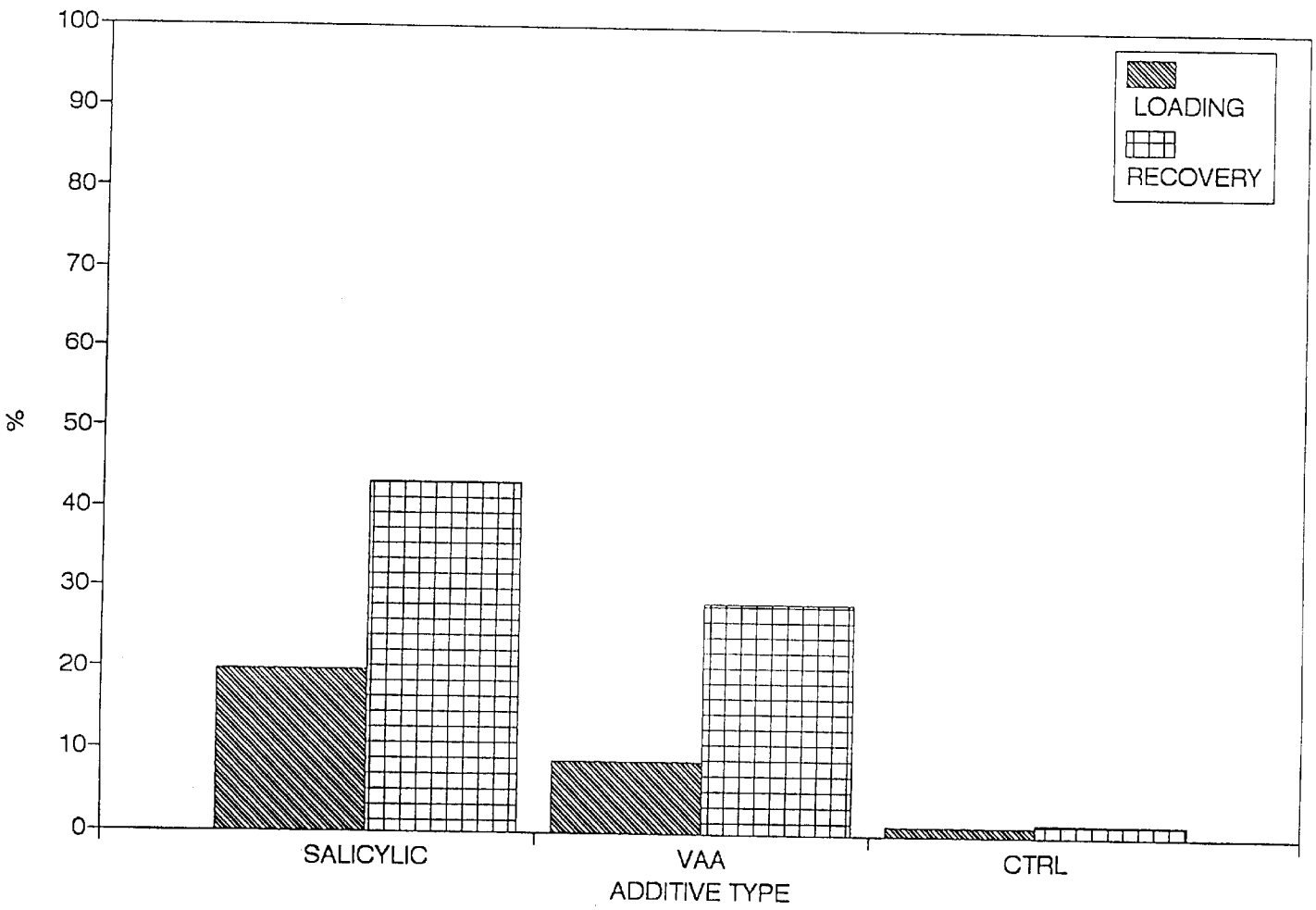

FIG. 2: 0.1 g BBP, with 0.005 g salicylic acid or 0.0066 g vinylacetic acid, were-dissolved in Isopar L to make 100 g total solution.

Figure 3:
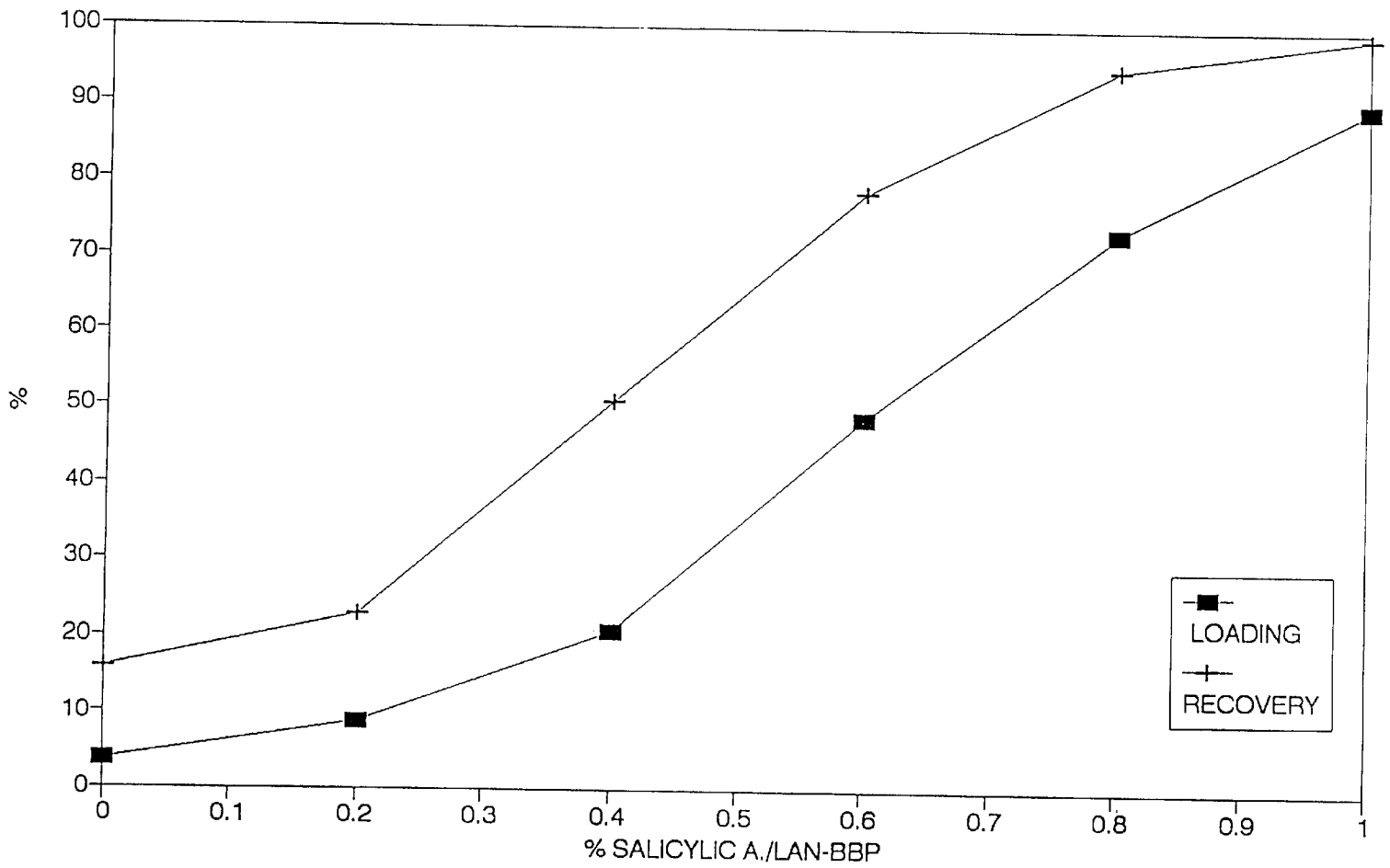

FIG. 3: 0.05 g lecithin and 0.05 g BBP, with varying amounts of salicylic acid (% based on total weight of charge director), were dissolved in Isopar L to make 100 g total solution.

As is clearly seen from these Figures, the addition of stabilizing components to solutions of charge director material substantially improves the electrical stability of these solutions.

Conductivity kinetics (stability of conductivity with time)

Figure 4:
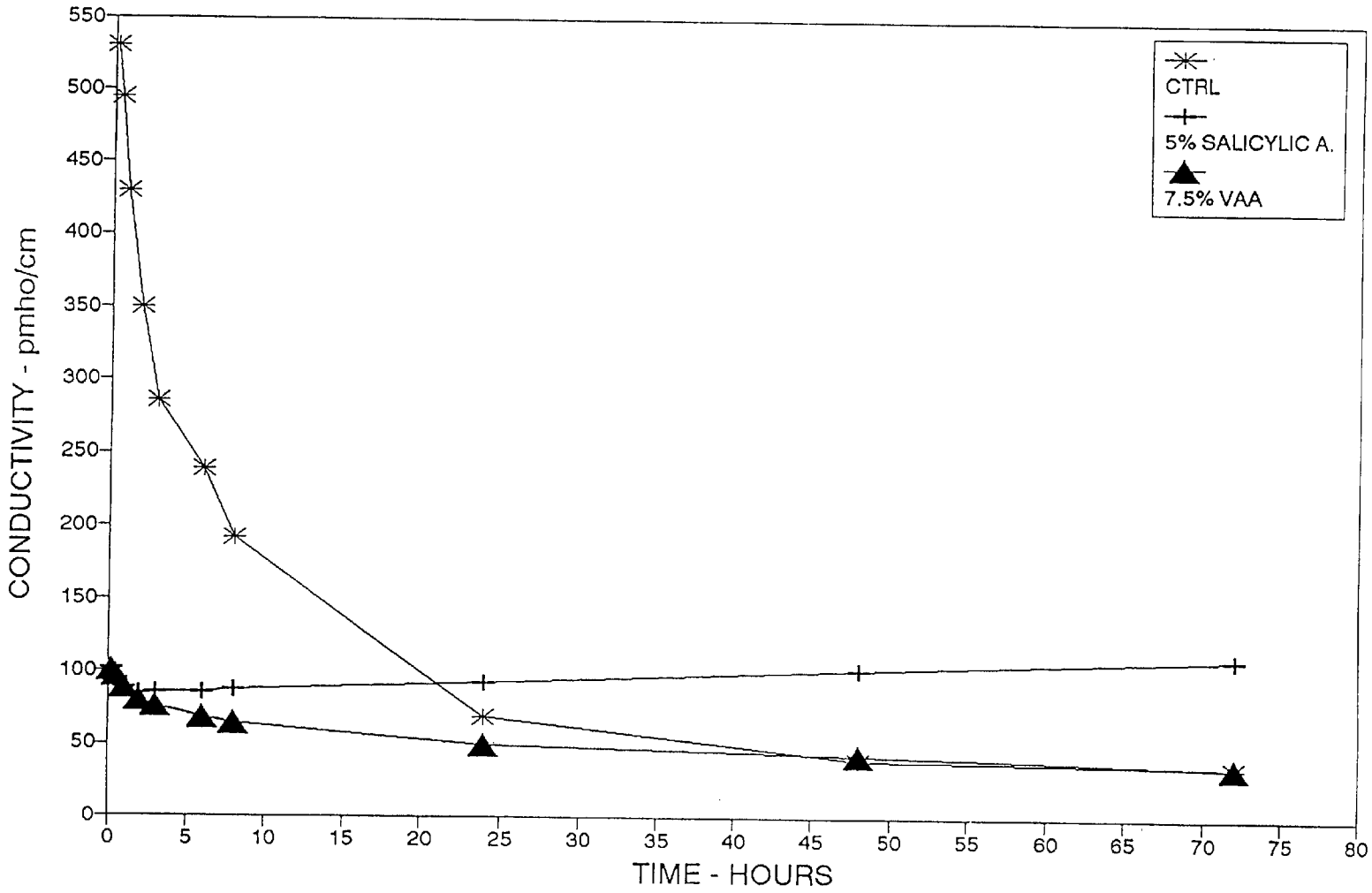
FIGS. 4 and 5 show the effect of the stabilizing component of the invention on the conductivity kinetics of compositions containing charge directors.

FIG. 4 shows the effect of salicylic acid and vinylacetic acid on BBP conductivity kinetics. Five percent (5%) by weight (to BBP) of salicylic acid or seven and one-half percent (7.5% by weight (to BBP) were added to a 10% stock solution of BBP in Isopar L. This solution was diluted to a 0.1% total solids weight solution by the addition of Isopar L and the conductivity of this solution was measured as a function of time after the dilution.

Figure 5:
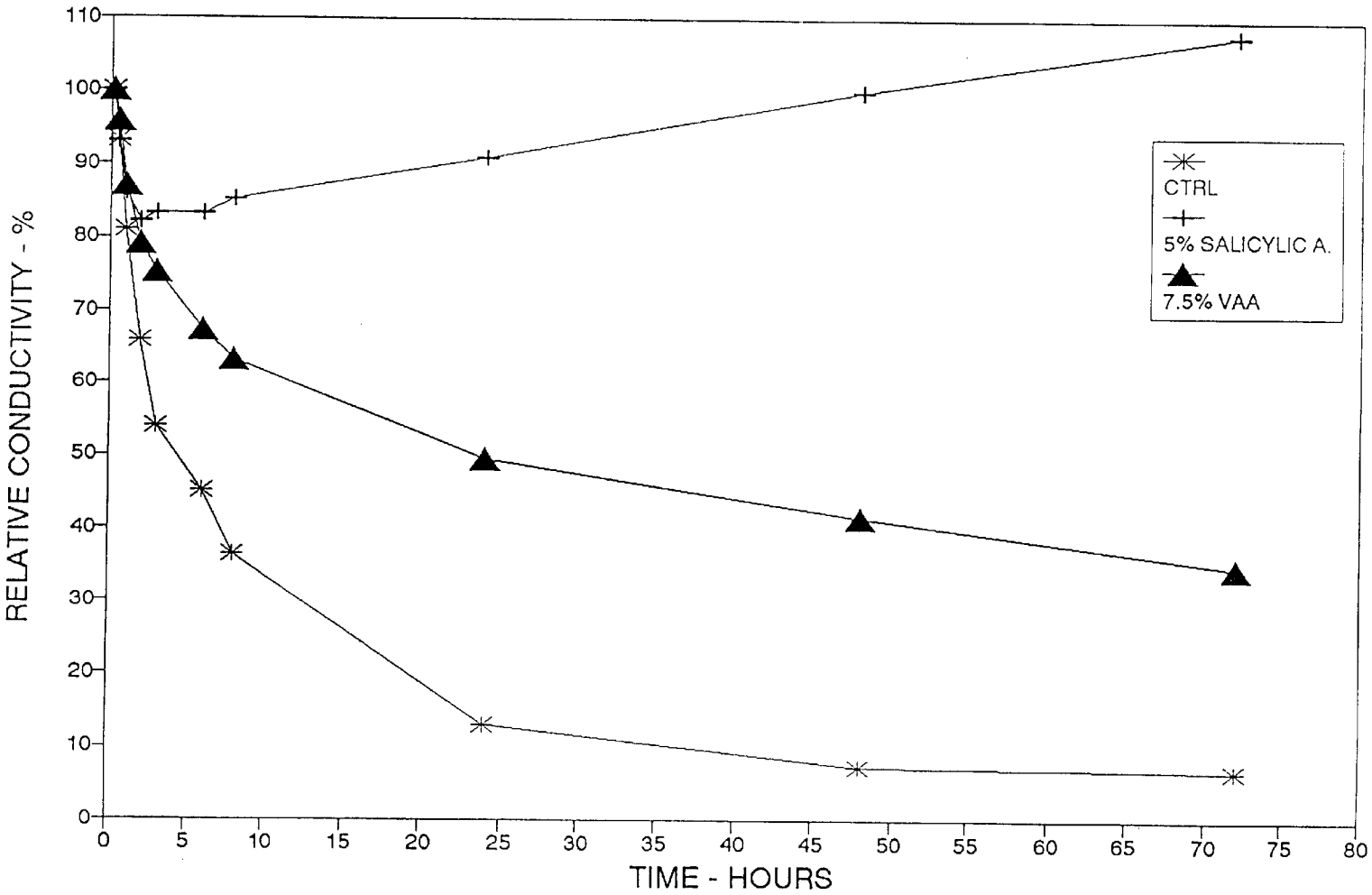

FIG. 5 shows the time kinetics of conductivity for the same experiment normalized to the initial value of conductivity for each solution tested.

While the present invention has been particularly described, persons skilled in the art will appreciate that many variations and modifications can be made. Therefore, the invention is not to be construed as restricted to the particularly described embodiments, rather the scope, spirit and concept of the invention will be more readily understood by reference to the claims which follow.

I claim:

1. An electrostatic imaging process which comprises:

forming a charged latent electrostatic image on a photoconductive surface;

applying to said surface oppositely charged pigmented thermoplastic particles from a toner composition produced by a method which comprises:

(A) first making a liquid solution which comprises:

(1) liquid hydrocarbon compatible with the components of the liquid toner;

(2) at least one charge director which is operative to charge the particles with a negative charge; and (3) at least one stabilizing component in an amount effective to stabilize the electrical properties of the at least one charge director, the at least one stabilizing component being selected from the group consisting of solubilizable acids which include organic moieties wherein the stabilizing component and the charge director are in the weight ratio between 0.01 and 2.0:1; and (B) mixing the solution from (A) with pigmented thermoplastic resin particles, and optionally further liquid hydrocarbon (1) as defined above, such that the pigmented particles are microdispersed in the toner composition; and transferring the resulting toner image to a substrate.

2. A process according to claim 1, wherein the liquid hydrocarbon (1) comprises an insulating non-polar carrier liquid having a volume resistivity of above $10^9$ ohm-cm and a dielectric constant below 3.0.

3. A process according to claim 1, wherein said at least one stabilizing component is at least one solubilizable acid containing moieties selected from the group consisting of $C_{12}$ to $C_{18}$ saturated aliphatic carboxylic acids.

4. A process according to claim 3, wherein the at least one stabilizing component is at least one solubilizable acid containing organic moieties selected from the group consisting of lauric and stearic acid.

5. A process according to claim 1, wherein the at least one stabilizing component is at least one solubilizable acid containing organic moieties selected from the group consisting of $C_4$ to $C_{18}$ ethylenically unsaturated aliphatic carboxylic acids.

6. A process according to claim 5, wherein the at least one stabilizing component is at least one solubilizable acid containing organic moieties selected from the group consisting of vinylacetic and crotonic acids.

7. A process according to claim 6, wherein the at least one stabilizing component comprises vinylacetic acid.

8. A process according to claim 3, wherein the at least one stabilizing component comprises oleic acid.

9. A process according to claim 1, wherein the at least one stabilizing component is at least one solubilizable acid containing organic moieties selected from the group consisting of $C_7$ to $C_{13}$ ethylenically aromatic carboxylic acids.

10. A process according to claim 9, wherein the at least one stabilizing component is at least one solubilizable acid containing organic moieties selected from the group consisting of benzoic, salicylic and diisopropyisalicylic acids.

11. A process according to claim 10, wherein said at least one stabilizing component comprises salicylic acid.

12. A process according to claim 1, wherein the at least one stabilizing component is at least one solubilizable acid containing organic moieties selected from the group consisting of partial alkyl esters of orthophosphoric acid contain 12 to 36 carbon atoms.

13. A process according to claim 12, wherein the at least one stabilizing component is at least one solubilizable acid containing organic moieties selected from the group consisting of partial dialkyl esters of orthophosphoric acid containing 12 to 36 carbon atoms.

14. A process according to claim 1, wherein the partial dialkyl ester is di(2-ethylhexyl) phosphate.

15. A process according to claim 1, wherein said at least one charge director is selected from the group consisting of lecithin, basic barium petronate and calcium petronate.

16. An electrostatic imaging process which comprises:

forming a charged latent electrostatic image on a photoconductive surface;

applying to said surface oppositely charged pigmented thermoplastic particles from a toner composition produced by a method which comprises:

(A) first making a liquid solution which comprises:

(1) liquid hydrocarbon compatible with the components of the liquid toner;

(2) at least one charge director which is operative to charge the particles with a negative charge; and (3) at least one stabilizing component in an amount effective to stabilize the electrical properties of the at least one charge director, the stabilizing component being a solubilizable acid which includes organic moieties selected from the group consisting of crotonic acid, stearic acid, salicylic acid, di(2-ethylhexyl) phosphate, vinylacetic acid, diisopropyisalicylic acid and benzoic acid; and (B) mixing the solution from step (A) with pigmented thermoplastic resin particles, and optionally further hydrocarbon (1) as defined above, such that the pigmented particles are microdispersed in the toner composition; and transferring the resulting toner image to a substrate.

17. A process according to claim 16, wherein the at least one stabilizing component comprises crotonic acid.

18. A process according to claim 17, wherein the at least one stabilizing component comprises stearic acid.

19. A process according to claim 17, wherein the at least one stabilizing component comprises salicylic acid.

20. A process according to claim 17, wherein the at least one stabilizing component comprises di(2-ethylhexyl) phosphate.

21. A process according to claim 17, wherein the at least one stabilizing component comprises vinylacetic acid.

22. A process according to claim 21, wherein the stabilizing component and the charge director are in the weight ratio between 0.066 and 0.1:1.

23. A process according to claim 17, wherein the at least one stabilizing component comprises diisopropyisalicylic acid.

24. A process according to claim 21, wherein the at least one stabilizing component comprises benzoic acid.

* * * * *

UNITED STATES PATENT AND TRADEMARK OFFICE

CERTIFICATE OF CORRECTION

PATENT NO. : 5,935,754

DATED : August 10, 1999

INVENTOR(S) : Y. ALMOG

It is certified that error appears in the above-identified patent and that said Letters Patent is hereby corrected as shown below:

On the cover of the printed patent, at item [56], References Cited, Other Publications, change "pp. 227-231" to ---pp. 227-234, 239-241---.

On the cover of the printed patent, at item [56], References Cited, the following U.S. Patent Documents were omitted and should be included:

| | | |
|---|---|---|
| ---5,002,848 | 3/1991 | El-Sayed et al. |
| 4,897,332 | 1/1990 | Gibson et al. |
| 4,891,286 | 1/1990 | Gibson |
| 3,681,243 | 8/1972 | Okuno et al. |
| 4,473,629 | 9/1984 | Herman et al. |
| 3,507,679 | 4/1970 | Metcalfe et al. |
| 5,266,435 | 11/1993 | Almog |
| 5,308,731 | 5/1994 | Larson et al. |
| 5,019,477 | 5/1991 | Felder--- |

On the cover of the printed patent, at item [56], References Cited, the following Foreign Patent Document was omitted and should be included:

| | | |
|---|---|---|
| ---456177 | 11/1991 | EPO--- |

On the cover of the printed patent, at item [56], References Cited, the following Other Publications were omitted and should be included:

---Savin competitive copier guide, May 1984 (Savin 880/870).

Liquid Toner Technology: The Key to Savin Success (1984), the cover page and pages 5, 21 and 22.

Colloids and Surfaces in Reprographic Technology; F.M. Fowkes et al., pp.307-324; Hair & Croucher ACS Symposium Series, 1982.

Electrophotography, Metcalfe et al., John Wiley and Sons, NY, pp.

UNITED STATES PATENT AND TRADEMARK OFFICE

CERTIFICATE OF CORRECTION

PATENT NO. : 5,935,754

DATED : August 10, 1999

INVENTOR(S) : Y. ALMOG

It is certified that error appears in the above-identified patent and that said Letters Patent is hereby corrected as shown below:

PAGE 2 of 2

562-566 (1975).—

At column 7, line 35 (claim 12, line 4) of the printed patent, "contain" should be —containing—.

At column 7, line 42 (claim 14, line 1) of the printed patent, "1" should be —13—.

At column 8, line 28 (claim 18, line 1) of the printed patent, "17" should be —16—.

At column 8, line 30 (claim 19, line 1) of the printed patent, "17" should be —16—.

At column 8, line 32 (claim 20, line 1) of the printed patent, "17" should be —16—.

At column 8, line 35 (claim 21, line 1) of the printed patent, "17" should be —16—.

At column 8, line 40 (claim 23, line 1) of the printed patent, "17" should be —16—.

At column 8, line 43 (claim 24, line 1) of the printed patent, "17" should be —16—.

Signed and Sealed this

Twenty-fourth Day of October, 2000

*Attest:*

Q. TODD DICKINSON

*Attesting Officer*

*Director of Patents and Trademarks*